US009257790B2

(12) United States Patent
Chang et al.

(10) Patent No.: US 9,257,790 B2
(45) Date of Patent: Feb. 9, 2016

(54) ELECTRICAL CONNECTOR HAVING IMPROVED SHIELDING MEANS

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW); Ke-Hao Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/285,540

(22) Filed: May 22, 2014

(65) Prior Publication Data

US 2014/0349518 A1 Nov. 27, 2014

(30) Foreign Application Priority Data

May 22, 2013 (TW) ..... 102118098 A

(51) Int. Cl.

| | |
|---|---|
| ***H01R 13/648*** | (2006.01) |
| ***H01R 13/646*** | (2011.01) |
| ***H01R 13/6585*** | (2011.01) |
| *H01R 13/24* | (2006.01) |
| *H01R 13/6594* | (2011.01) |
| *H01R 43/24* | (2006.01) |
| *H01R 107/00* | (2006.01) |

(52) U.S. Cl.

CPC ..... *H01R 13/646* (2013.01); *H01R 13/6585* (2013.01); *H01R 13/2435* (2013.01); *H01R 13/6594* (2013.01); *H01R 43/24* (2013.01); *H01R 2107/00* (2013.01)

(58) Field of Classification Search

CPC ..... H01R 13/646; H01R 13/65802; H01R 13/6588; H01R 13/6461; H01R 23/6873; H01R 23/688

USPC ..... 439/607.01, 607.08, 607.09, 66, 65, 439/607.4

See application file for complete search history.

(56) References Cited

U.S. PATENT DOCUMENTS

| | | | | |
|---|---|---|---|---|
| 6,758,695 | B2 * | 7/2004 | Pepe et al. | 439/607.08 |
| 2014/0162471 | A1 * | 6/2014 | Hwang et al. | 439/65 |
| 2014/0329408 | A1 * | 11/2014 | Chang et al. | 439/607.01 |

FOREIGN PATENT DOCUMENTS

| | | |
|---|---|---|
| CN | 202196955 | 1/2012 |

* cited by examiner

*Primary Examiner* — Hae Moon Hyeon

(74) *Attorney, Agent, or Firm* — Wei Te Chung; Ming Chieh Chang

(57) ABSTRACT

An electrical connector includes a housing unit and a contact unit received therein. The housing unit includes a shielding member and an insulating member retained on the shielding member. The shielding member defines opposite upper end and lower end while the insulating member includes a first portion and a second portion seated on the upper and lower ends respectively and defines a cavity therebetween. The contact unit includes a plurality of contacts, a metal plate defining a plurality of through holes and an insulating body retaining the contacts and the metal plate. The metal plate divides the cavity into a first cavity and a second cavity, the contact runs through the through hole of the metal plate and comprises a first arm above the metal plate received in the first cavity and a second arm under the metal plate received in the second cavity.

18 Claims, 4 Drawing Sheets

ELECTRICAL CONNECTOR HAVING IMPROVED SHIELDING MEANS

BACKGROUND OF THE INVENTION

1. Field of the Invention

The present disclosure relates to an electrical connector, and more particularly to an electrical connector for connecting an Integrated Circuit (IC) package with a printed circuit board (PCB).

2. Description of the Related Art

Various electrical connectors are widely used in computer and other electronic devices. An electrical connector for electrically connecting an IC package to a printed circuit board (PCB) typically comprises an insulating housing and a plurality of contacts retained therein. The contacts connect the IC package and the PCB so as to establish an electrical connection therebetween. However with increasing of the amount and speed of the data transmitted by the contacts, the arrangement density of the contacts increases and the electromagnetic interference (EMI) between the contacts becomes more and more serious. Therefore, an electrical connector with shielding plates around the contacts is provided. CN Patent No. 202196955 issued on Apr. 18, 2012 discloses an electrical connector. The electrical connector comprises an insulating housing having a plurality of receiving holes, a plurality of contacts received in the receiving holes and a metallic frame insert-molded in the insulating housing and surrounding the contacts. The metallic frame can reduce the EMI between the contacts. However, as each of the contacts comprises a contacting portion extending beyond the metallic frame to contact the IC package or the PCB, which fails to be protected by the metallic frame and have a high EMI issue.

In view of the above, an improved electrical connector is desired to overcome the problems mentioned above.

SUMMARY OF THE INVENTION

Accordingly, an object of the present disclosure is to provide an improved shielding electrical connector.

In order to achieve the object set forth, an electrical connector having improved shielding means is provided. The electrical connector comprises a housing unit and a contact unit received therein. The housing unit comprises a shielding member and an insulating member retained on the shielding member. The shielding member defines opposite upper end and lower end while the insulating member comprises a first portion and a second portion seated on the upper and lower ends respectively and defines a cavity therebetween. The contact unit comprises a plurality of contacts, a metal plate defining a plurality of through holes and an insulating body retaining the contacts and the metal plate. The metal plate divides the cavity into a first cavity and a second cavity, the contact runs through the through hole of the metal plate and comprises a first arm above the metal plate received in the first cavity and a second arm under the metal plate received in the second cavity.

DESCRIPTION OF PREFERRED EMBODIMENT

Reference will now be made to the drawings to describe the present disclosure in detail.

Figure 1:
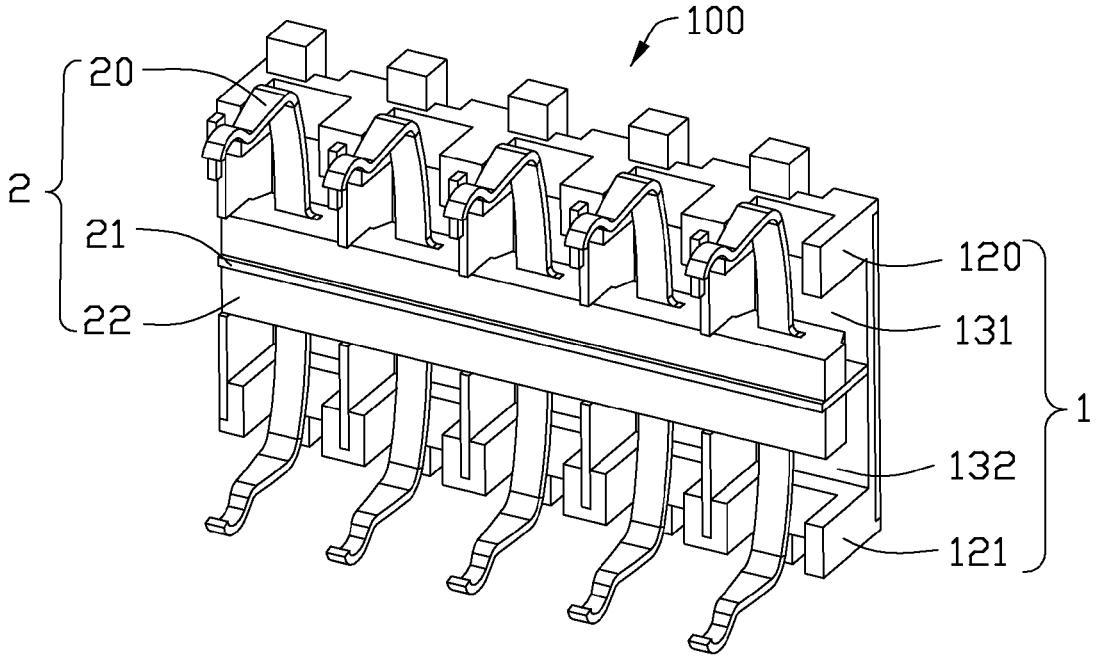
FIG. 1 is a perspective view of an electrical connector unit of an electrical connector in accordance with a preferred embodiment of the present disclosure.
Figure 2:
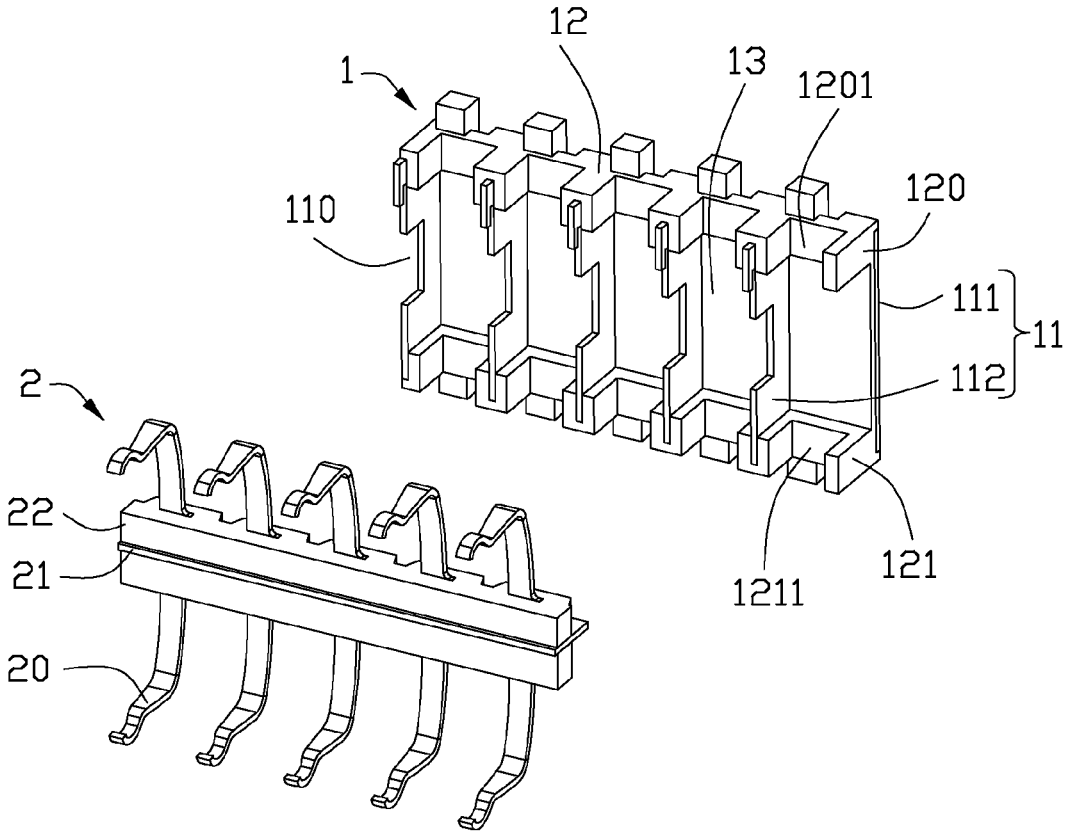
FIG. 2 is an exploded, perspective view of the electrical connector unit shown in FIG. 1.

Referring to FIGS. 1 to 2, an electrical connector for electrically connecting an IC package (not show) with a printed circuit board (PCB) (not show) is provided. The electrical connector comprises a plurality of electrical connector units 100. The electrical connector unit 100 comprises a housing unit 1 and a contact unit 2 received in the housing unit 1.

Figure 3:
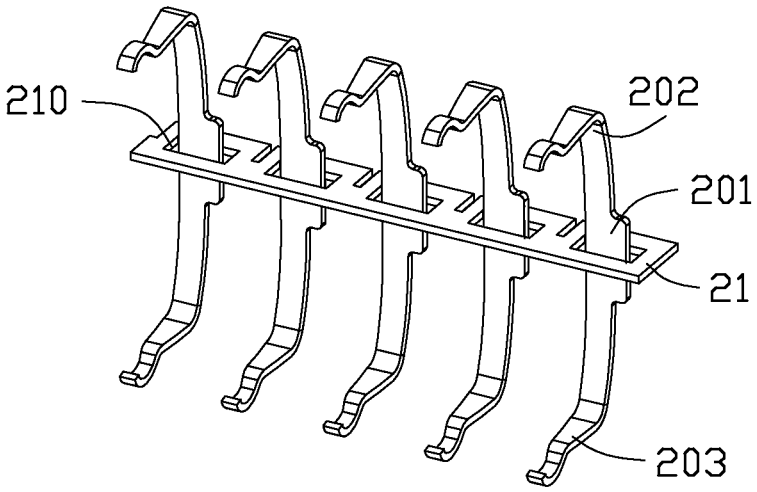
FIG. 3 is a perspective view of a metal plate and contacts of the electrical connector unit shown in FIG. 1.

Referring to FIG. 2 and FIG. 3, the contact unit 2 comprises a plurality of contacts 20 arranged in a row in a longitudinal direction, a metal plate 21 having a plurality of through holes 210 for the contacts 20 going through and a insulating body 22 retaining the contacts 20 and the metal plate 21. The contact 20 comprises a retention portion 201, a first arm 202 extending upwardly from the retention portion 201 for contacting the IC package and a second arm 203 extending downwardly from the retention portion 201 for contacting the PCB. The metal plate 21 locates around the retention portion 201 while the first and second arms 202, 203 of the contact 20 locate on two opposite sides of the metal plate 21. The contact 20 is axial symmetric along the metal plate 21. The retention portion 201 and the metal plate 21 are insert-molded with the insulating body 22. The insulating body 22 is made from low dielectric constant thermoplastic plastic, whose dielectric constant is less than 4. For example, the insulating body 22 can be made from Polyetherimide (PEI), whose dielectric constant is 2.3.

Figure 4:
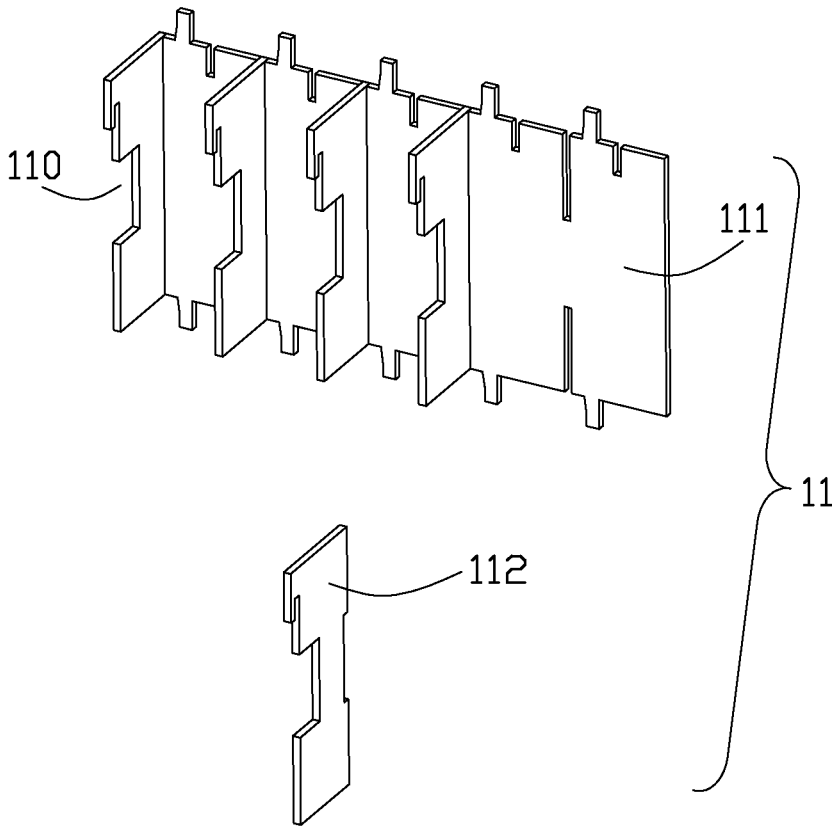
FIG. 4 is a perspective view of a shielding member of the electrical connector unit shown in FIG. 1.

Referring to FIGS. 2 and 4, the housing unit 1 comprises a shielding member 11 and an insulating member 12 insert-molded with the shielding member 11. The shielding member 11 extends in the longitudinal direction to define a plurality of chambers. The shielding member 11 defines an upper end and a lower end opposite to each other in a vertical direction perpendicular to the longitudinal direction. The shielding member 11 comprises a first plate 111 extending in the longitudinal direction and a plurality of second plates 112 extending in a transverse direction perpendicular to both the longitudinal direction and the vertical direction. In this embodiment, the second plate 112 is assembled onto the first plate 111 while in other embodiment the second plate 112 can be formed by integrally stamped and bent from the first plate 111. Each of the second plates 112 comprises a recess 110 between the upper and lower ends and a plurality of recesses 110 are arranged in a row in the longitudinal direction. The insulating member 12 comprises a first portion 120 seated on the upper end of the shielding member 11 and a second portion 121 seated on the lower end of the shielding member 11. The first portion 120 and the second portion 121 define a cavity 13. The first portion 120 defines a plurality of first receiving slots 1201 for the first arm 202 going through while the second portion 121 defines a plurality of second receiving slots 1211 for the second arm 203 going through. In the embodiment, the insulating member 12 is made of liquid crystal polymer (LCP), whose dielectric constant is 4. In other embodiment, the insulating member 12 can also be made from low dielectric constant plastic, whose dielectric constant is less than 4, such as made from PEI.

Referring to FIG. 1, when assembling, the insulating body 22 of the contact unit 2 is assembled into the recesses 110 of the shielding member 11 in the transverse direction so as to form the electrical connector unit 100. The metal plate 21 divides the cavity 13 into a first cavity 131 and a second cavity 132. The contact 20 receives in the chamber correspondingly with the first arm 202 going through the first cavity 131 and beyond the first receiving slot 1201, and the second arm 203 going through the second cavity 132 and beyond the second receiving slot 1211. Through assembling a plurality of electrical connector units 100 together side by side can form a matrix type arrangement wholly.

According to the above described embodiments, an improved shielding electrical connector is provided. The electrical connector comprises a metal plate 21 dividing a cavity 13 into two independent, axial symmetrical first and second cavities; the contact 20 going through the first and second cavities is axial symmetrical along the metal plate 21, which can reduce the EMI between two contacts. And, the insulating body 22 is made from low dielectric constant plastic which can also reduce the EMI therebetween. Another aspect, the metal plate 21 insert-molded into the insulating body 22 can increase the strength of the electrical connector.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a housing unit, comprising a shielding member extending in a longitudinal direction and an insulating member retained on the shielding member, the shielding member defining an upper end and a lower end opposite to each other in a vertical direction perpendicular to the longitudinal direction, the insulating member comprising a first portion and a second portion seated on the upper and lower ends respectively and defining a cavity therebetween; and a contact unit received in the housing unit, the contact unit comprising a plurality of contacts arranged in a row, a metal plate extending horizontally in the longitudinal direction and an insulating body retaining the contacts and the metal plate; wherein the metal plate divides the cavity into a first cavity and a second cavity in the vertical direction, the contact comprises a first arm above the metal plate received in the first cavity and a second arm under the metal plate received in the second cavity.

2. The electrical connector as claimed in claim 1, wherein the dielectric constant of the insulating body is less than that of the insulating member.

3. The electrical connector as claimed in claim 2, wherein the insulating body is made from polyetherimide (PEI) while the insulating member is made from liquid crystal polymer (LCP).

4. The electrical connector as claimed in claim 1, wherein the dielectric constant of the insulating body is less than 4.

5. The electrical connector as claimed in claim 1, wherein the shielding member comprises a plurality of recesses between the first and second portions, the insulating body is assembled and retained into the recesses.

6. The electrical connector as claimed in claim 5, wherein the shielding member comprises a first plate and a plurality of second plates intersecting the first plate, the recesses are formed on the second plates.

7. The electrical connector as claimed in claim 1, wherein the first cavity and the second cavity are axial symmetrical along the metal plate.

8. The electrical connector as claimed in claim 7, wherein the contact is axial symmetrical along the metal plate.

9. The electrical connector as claimed in claim 1, wherein the contacts and the metal plate are insert-molded into the insulating body, the shielding member is insert-molded with the insulating member.

10. An electrical connector for electrically connecting an IC package with a printed circuit board (PCB), comprising:

at least one contact unit, comprising an insulating body and a plurality of contacts retained therein; and at least one housing unit receiving the contact unit, the housing unit comprising a metallic shielding member extending in a longitudinal direction and an insulating member retaining the shielding member; wherein the insulating member comprises a first portion and a second portion opposite to each other in a vertical direction perpendicular to the longitudinal direction, the insulating body locates between the first and second portions, both the insulating body and the insulating member are made from plastic, and wherein the dielectric constant of the insulating body is less than that of the insulating member.

11. The electrical connector as claimed in claim 10, wherein the contact unit comprises a metal plate extending in the longitudinal direction insert-molded into the insulating body.

12. The electrical connector as claimed in claim 11, wherein the housing unit is substantially axial symmetrical along the metal plate.

13. The electrical connector as claimed in claim 11, wherein the insulating member comprises a cavity between the first portion and the second portion, the metal plate divides the cavity into two symmetrical cavities in the vertical direction.

14. The electrical connector as claimed in claim 13, wherein the contact comprises first and second arms extending upwardly and downwardly in the vertical direction running through the cavity and beyond the insulating member for contacting the IC package and the PCB.

15. An electrical connector comprising:

a housing unit including shielding structures in matrix along longitudinal and transverse directions angled to each other to form thereof a plurality of chambers each surrounded by said shielding structures;

a contact unit including a plurality of contacts disposed in the corresponding chambers, respectively, each of said contact defining two opposite contacting ends in a vertical direction perpendicular to both said longitudinal direction and said transverse direction; and a metallic plate extending along a horizontal plane configurationally defined by said longitudinal direction and said transverse direction, with corresponding through holes to allow said contacts to extend therethrough, without laterally contacting the metallic plate, in the vertical direction so as to divide the corresponding chamber into opposite upper and lower cavities in the vertical direction for reducing EMI (Electro-Magnetic Interference) along the vertical direction; wherein said metallic plate is equipped with an insulating body integrally formed with both said contacts and the metallic plate via an insert molding process; wherein said housing unit includes an insulating member integrally formed with the shielding structures via another insert molding process.

16. The electrical connector as claimed in claim 15, wherein each of said contacts defines a symmetrical configuration, with regard to a horizontal center plane, in said vertical direction, and said horizontal plane is coplanar with said horizontal center plane.

17. The electrical connector as claimed in claim 16, wherein the metallic plate is mechanically and electrically connected to the shielding structure.

18. The electrical connector as claimed in claim 15, wherein said insulating body fills the corresponding through holes to laterally isolate the corresponding contacts from the metallic plate.

* * * * *